US007656365B2

(12) United States Patent
Moore

(10) Patent No.: US 7,656,365 B2
(45) Date of Patent: Feb. 2, 2010

(54) DOUBLE-SIDED FIBER-BASED DISPLAYS

(76) Inventor: Chad Byron Moore, 7 W. 4th St., Corning, NY (US) 14830

( * ) Notice: Subject to any disclaimer, the term of this patent is extended or adjusted under 35 U.S.C. 154(b) by 626 days.

(21) Appl. No.: 11/365,157

(22) Filed: Mar. 1, 2006

(65) Prior Publication Data

US 2006/0214880 A1 Sep. 28, 2006

Related U.S. Application Data

(60) Provisional application No. 60/665,781, filed on Mar. 28, 2005.

(51) Int. Cl.
*G09G 5/00* (2006.01)

(52) U.S. Cl. ..... 345/1.1; 345/1.3; 345/87

(58) Field of Classification Search ..... 345/60
See application file for complete search history.

(56) References Cited

U.S. PATENT DOCUMENTS 3,521,941 A * 7/1970 Deb et al. ..... 345/105
3,767,392 A 10/1973 Ota
3,790,841 A * 2/1974 Tsui et al. ..... 313/484
3,964,050 A 6/1976 Mayer
4,126,854 A 11/1978 Sheridon
4,896,149 A 1/1990 Buzak et al.
4,973,951 A * 11/1990 Shigeta et al. ..... 345/1.3
5,304,895 A * 4/1994 Ujihara ..... 345/76
5,739,801 A 4/1998 Sheridon
5,961,804 A 10/1999 Jacobson et al.
5,984,747 A 11/1999 Bhagavatula et al.
5,985,700 A 11/1999 Moore
6,111,191 A 8/2000 Hall et al.
6,166,711 A * 12/2000 Odake ..... 345/60
6,171,762 B1 1/2001 Borrelli et al.
6,197,429 B1 3/2001 Lapp et al.
6,247,987 B1 * 6/2001 Moore ..... 445/24
6,354,899 B1 3/2002 Moore
6,414,433 B1 * 7/2002 Moore ..... 313/582
6,431,935 B1 8/2002 Moore
6,452,332 B1 * 9/2002 Moore ..... 313/582
6,459,200 B1 * 10/2002 Moore ..... 313/582
6,507,146 B2 1/2003 Moore (Continued)

OTHER PUBLICATIONS

Martin, WJ, IBM Technical Disclosure, TDB 02-76 p. 2936-2938.*

*Primary Examiner*—Richard Hjerpe
*Assistant Examiner*—Dorothy Webb
(74) *Attorney, Agent, or Firm*—Brown & Michaels, PC

(57) ABSTRACT

A double-sided fiber-based display includes a plasma tube array sandwiched between two electro-optic materials. The electro-optic materials are preferably sandwiched between two fiber arrays. The two fiber arrays contain wire electrodes to set the charge in the plasma tubes and are parallel to each other and orthogonal to the plasma tube array. The fibers can be alternatively coated with a transparent conductive coating, such as a carbon nanotube film, to spread the voltage across the surface of the fiber. The plasma tubes contain wire electrodes to ignite a plasma along its entire length. The tube surfaces that are in contact with the electro-optic materials are preferably thin and flat. The fiber and plasma tube wire electrodes are preferably directly connected to a circuit board which houses electronics to address the display.

20 Claims, 10 Drawing Sheets

U.S. PATENT DOCUMENTS

| | | | | |
|---|---|---|---|---|
| 6,524,773 | B1 | 2/2003 | Borrelli et al. | |
| 6,570,339 | B1 | 5/2003 | Moore | |
| 6,583,770 | B1 * | 6/2003 | Antila et al. | 345/1.1 |
| 6,611,100 | B1 | 8/2003 | Moore | |
| 6,750,605 | B2 | 6/2004 | Moore | |
| 6,771,234 | B2 | 8/2004 | Moore | |
| 6,819,309 | B1 * | 11/2004 | Kishi | 345/87 |
| 6,917,156 | B2 | 7/2005 | Moore | |
| 6,946,803 | B2 | 9/2005 | Moore | |
| 7,034,446 | B2 | 4/2006 | Moore | |
| 7,082,236 | B1 | 7/2006 | Moore | |
| 7,211,938 | B2 * | 5/2007 | Tanaka | 313/1 |
| 2001/0009352 | A1 * | 7/2001 | Moore | 313/582 |
| 2001/0033483 | A1 | 10/2001 | Moore | |
| 2002/0140133 | A1 | 10/2002 | Moore | |
| 2002/0149717 | A1 | 10/2002 | Borrelli et al. | |
| 2003/0170166 | A1 * | 9/2003 | Smalley et al. | 423/447.1 |
| 2006/0193031 | A1 | 8/2006 | Moore | |

* cited by examiner

DOUBLE-SIDED FIBER-BASED DISPLAYS

REFERENCE TO RELATED APPLICATIONS

This application claims an invention which was disclosed in Provisional Application No. 60/665,781, filed Mar. 28, 2005, entitled "DOUBLE-SIDED FIBER-BASED DISPLAYS". The benefit under 35 USC §119(e) of the United States provisional application is hereby claimed, and the aforementioned application is hereby incorporated herein by reference.

FIELD OF THE INVENTION

The invention pertains to the field of fiber-based displays and methods of manufacture. More particularly, the invention pertains to actively addressing two electro-optic materials using a single array of plasma tubes.

BACKGROUND OF THE INVENTION

There are several different methods of producing a reflective and transmissive display. The most well known and widely used method uses liquid crystal molecules as the electro-optic material. In the liquid crystal family, a vast range of molecules could potentially be used to create the electro-optic modulated material. Some of these liquid crystal molecules include, but are not limited to, twisted nematic, cholesteric-nematic, dichroic dye (or guest-host), dynamic scattering mode, and polymer dispersed molecules. Most of these liquid crystal molecules require other films, such as alignment layers, polarizers, and reflective films.

Another type of reflective display composing an electro-optic material is an electrophoretic display. Early work such as that described in U.S. Pat. No. 3,767,392, "ELECTROPHORETIC LIGHT IMAGE REPRODUCTION PROCESS", used a suspension of small charged particles in a liquid solution. The suspension is sandwiched between two glass plates with electrodes on the glass plates. If the particles have the same density as the liquid solution then they will not be effected by gravity, therefore the only way to move the particles is using an electric field. By applying a potential to the electrodes, the charged particles are forced to move in the suspension to one of the contacts. The opposite charge moves the particles to the other contact. Once the particles are moved to one of the contacts they reside at that point until they are moved by another electric field, therefore the particles are bistable. The electrophoretic suspension is designed such that the particles are a different color than the liquid solution. Therefore, moving the particles from one surface to the other will change the color of the display. One potential problem with this display is the agglomeration of the small charged particles when the display is erased, i.e., as the pixel is erased, the particles are removed from the contact in groups rather than individually. Microencapsulating the electrophoretic suspension in small spheres solves this problem, as shown in U.S. Pat. No. 5,961,804, "MICROENCAPSULATED ELECTROPHORETIC DISPLAY". FIG. 1 shows the typical operation of a microencapsulated electrophoretic display. In this display the particles are positively charged and are attracted to the negative terminal of the display by applying a voltage 7 across the electrophoretic material 37. The charged particles are white and the liquid solution they are suspended in is dark, therefore contrast in the display is optionally achieved by selectively moving some of the particles from one contact 5 to the other 5. In this type of display, the electro-optic material is the electrophoretic material and any casing used to contain the electrophoretic material.

A similar type of electro-optic display, a twisting ball display or Gyricon display, was invented by N. Sheridon at Xerox, and is shown in U.S. Pat. No. 4,126,854, "TWISTING BALL DISPLAY". It was initially called a twisting ball display because it is composed of small spheres, one side coated black, the other white, sandwiched between two electroded 5 glass plates. Upon applying an electric field 7, the spheres with a positive charged white half and relative negative charged black half are optionally addressed (rotated), as shown in FIG. 2. Once the particles are rotated they stay in that position until an opposite field is applied. This bistable operation requires no electrical power to maintain an image. A follow on patent, U.S. Pat. No. 5,739,801, disclosed a multithreshold addressable twisting ball display. In this type of display, the electro-optic material is the bichromal spheres and any medium they may reside in to lower their friction in order to rotate.

Most electro-optic displays have problems with addressing the display. Since most of the electro-optic materials do not have a voltage threshold, displays fabricated with the materials have to be individually addressed. Some of the liquid crystal materials use an active transistor back plane to address the displays, but these type of displays are presently limited in size due to the complicated manufacturing process. Transmissive displays using liquid crystal materials and a plasma addressed back plane have been demonstrated in U.S. Pat. No. 4,896,149 and are shown in FIG. 3. A pair of parallel electrodes 36 are deposited in each of the channels 35, and a very thin glass microsheet 33 forms the top of the channels. Channels 35 are defined by ribs 34, which are typically formed by screen printing or sand blasting. A liquid crystal layer 32 on top of the microsheet 33 is the optically active portion of the display. A cover sheet 30 with transparent conducting electrodes 31 running perpendicular to the plasma channels 35 lies on top of the liquid crystal 32. Conventional polarizers, color filters, and backlights, like those found in other liquid crystal displays, are also commonly used. Displays fabricated using the plasma addressed back plane shown in FIG. 3 are also limited in size due to availability of the thin microsheet 33. One potential solution for producing large size displays is to use fibers to create the plasma cells as shown in FIG. 4. Using tubes to create a plasma cell was first disclosed in U.S. Pat. No. 3,964,050, and using fibers with wire electrodes to create the column driving plane in a transmissive plasma addressed liquid crystal display was disclosed in U.S. Pat. No. 5,984,747.

All of the above mentioned prior art focuses on creating a single display viewable on the surface of the panel. Therefore, there is a need in the art for a structure that can be used to create two independent images on both surfaces of a display panel.

SUMMARY OF THE INVENTION

A double-sided fiber-based display includes a plasma tube array sandwiched between two electro-optic materials. The two electro-optical materials are preferably sandwiched between two fiber arrays. The two fiber arrays contain wire electrodes to set the charge in the plasma tubes and are parallel to each other and orthogonal to the plasma tube array. The fibers may be alternatively coated with a transparent conductive coating, such as a carbon nanotube film or a transparent conductive polymer coating, to spread the voltage across the surface of the fiber. Two electroded sheets may also be used to set the charge in the plasma tubes, where the electroded sheets are formed by placing wire electrodes into the surface of a polymer substrate and connecting patterned transparent conductive coating to the wire electrodes to spread the voltage placed on the wire electrodes across the surface of the pixels. The plasma tubes preferably contain wire electrodes to ignite a plasma along its entire length. The plasma tube surfaces that are in contact with the electro-optic materials are preferably thin and flat. The electro-optic material includes a liquid crystal material, an electrophoretic material, a bichromal sphere material, or any electro-optic material that can be modulated in an electrostatic field. The wire electrodes in the plasma tubes and column electrode plane are preferably directly connected to a circuit board, which houses electronics to address the display.

DESCRIPTION OF THE PREFERRED EMBODIMENT

Figure 1:
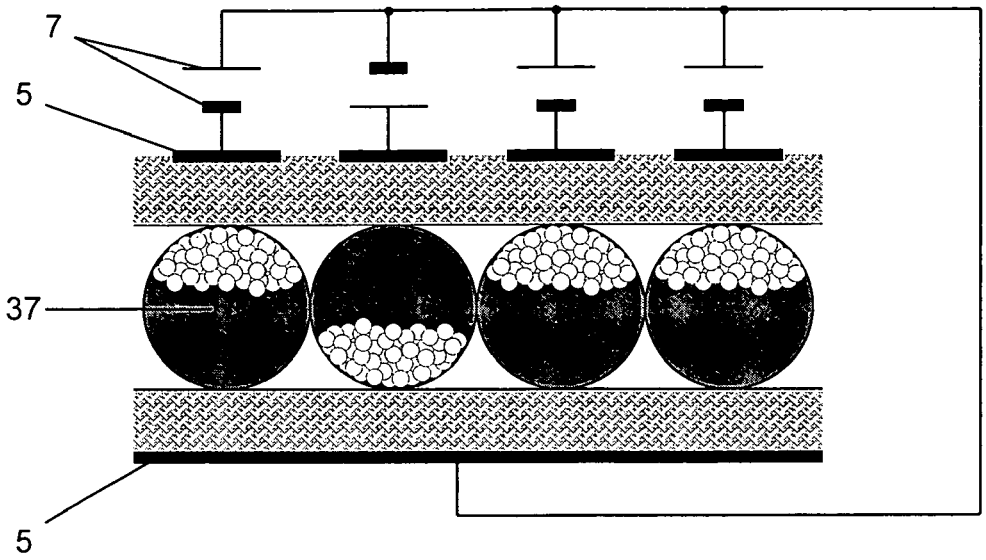
Figure 1 Prior Art
FIG. 1 schematically shows a cross-section and addressing of an electrophoretic display, in accordance with the prior art.
Figure 2:
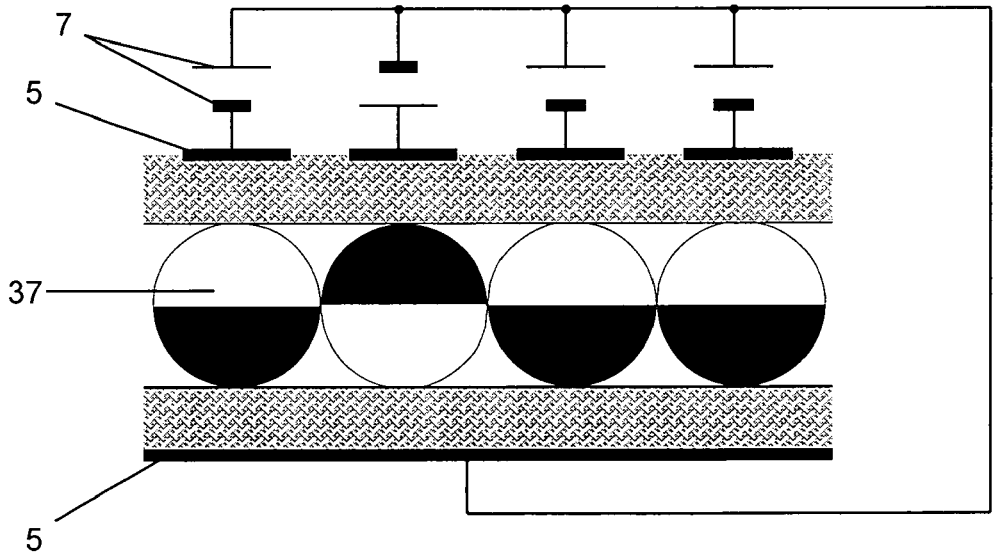
Figure 2 Prior Art
FIG. 2 schematically shows a cross-section and addressing of a bichromal sphere display in accordance with the prior art.
Figure 3:
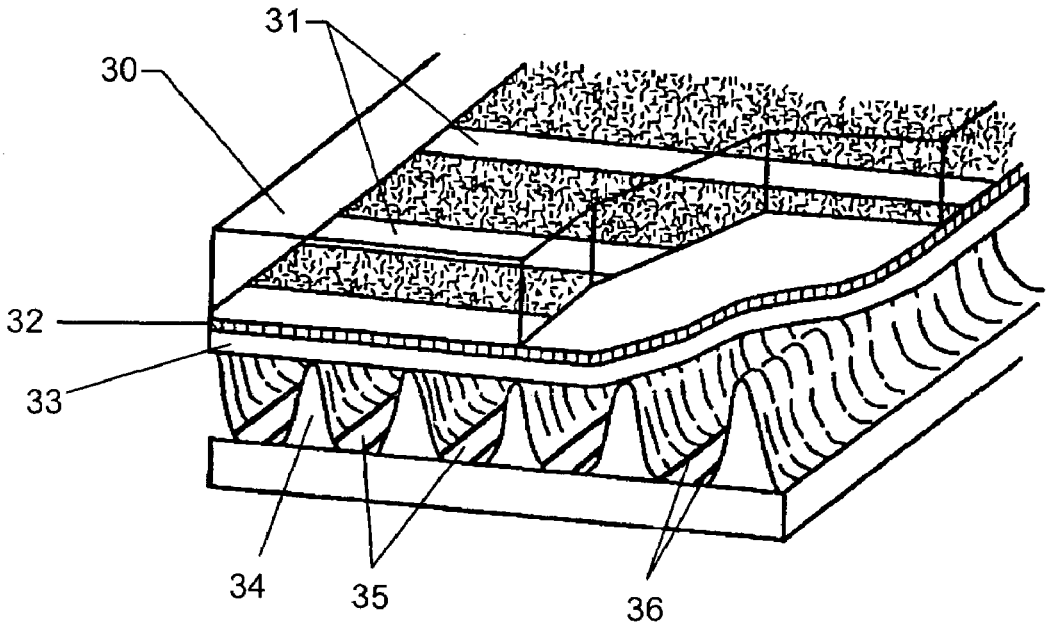
Figure 3 Prior Art
FIG. 3 illustrates a traditional PALC display in accordance with the prior art.
Figure 4:
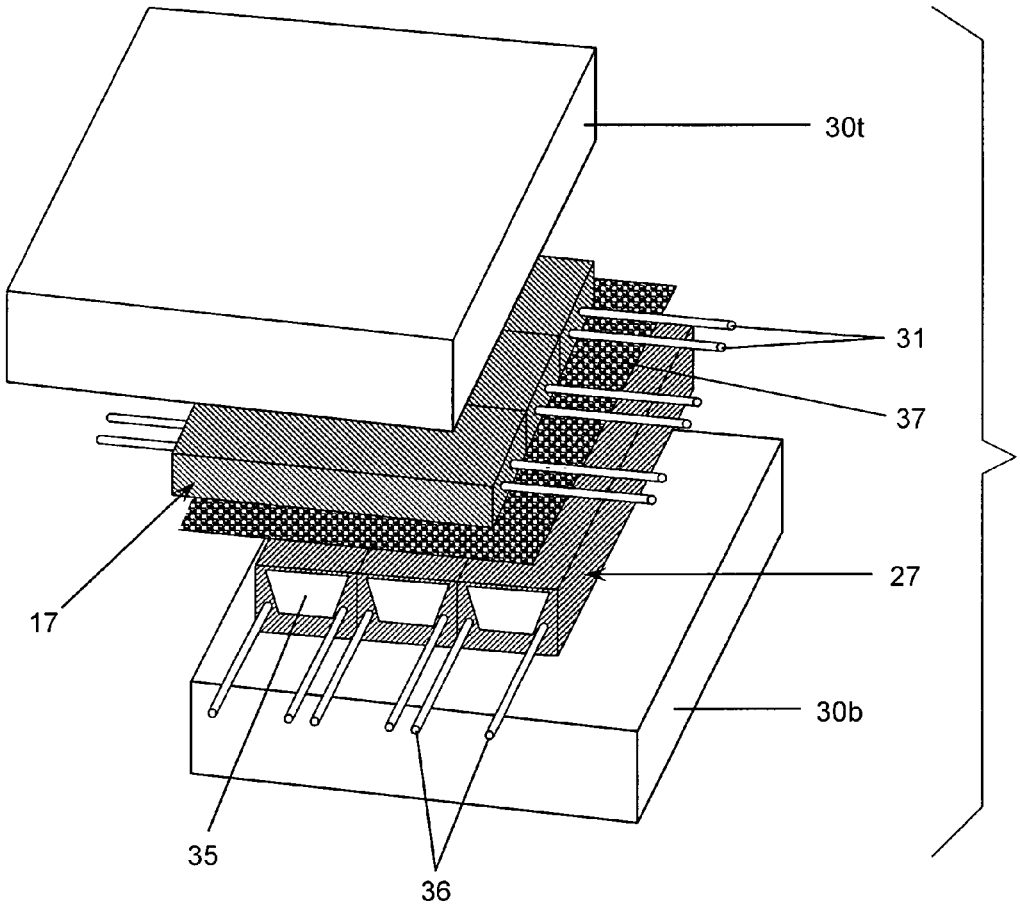
Figure 4 Prior Art
FIG. 4 illustrates a fiber-based plasma-addressed electro-optic display in accordance with the prior art.
Figure 5:
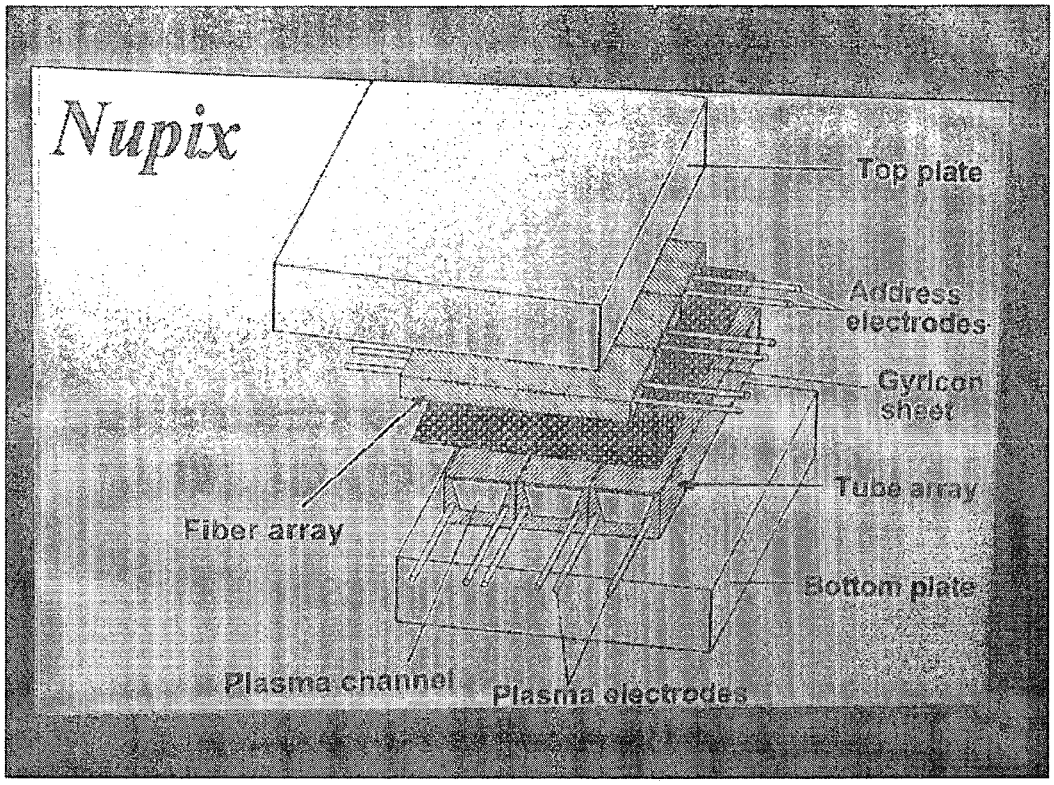
FIG. 5 is a photograph of an operating 46" diagonal, 20 dpi, fiber-based plasma-addressed display using Gyricon paper as an electro-optic material.

FIG. 4 shows a schematic of a reflective plasma-addressed electro-optic display using both a top fiber array 17 and a bottom plasma tube array 27 to create the structure in the display, as disclosed in U.S. Pat. No. 6,459,200, incorporated herein by reference. Using this structure a 46 inch diagonal (25.5"×38.4") 20 dots-per-inch display was fabricated, as shown in FIG. 5. The 46" diagonal display was fabricated using Gyricon paper 37 (shown in FIG. 2) as an electro-optic material 37. Gyricon paper 37 is reflective and bistable, which means once the image is written it is displayed with no power until another image is written. Note that the image in FIG. 5 shows the structure of the display shown in FIG. 4. The display has an addressable area of 25.55"×38.4" (46" diagonal) at a resolution of 20 dpi. The display was constructed using 511 plasma tubes and 768 top fibers. The display was assembled using an array of plasma tubes 27 placed on a bottom substrate 30*b*. A sheet of Gyricon paper 37 is then applied to the top surface of the plasma tubes 27 and sandwiched with an array of rectangular top fibers 17 with co-drawn wire electrodes 31. The top fiber array 17 is placed orthogonal to the plasma tube array 27 and a pixel is defined at every point where a top fiber 17 and plasma tube 27 cross. A top plate 30*t* is placed over the top fiber array 17 to complete the panel. The wire electrodes (31 and 36) from the plasma tubes 27 and top fibers 17 are connected directly to a circuit board, which houses the drive electronics.

Figure 6A:
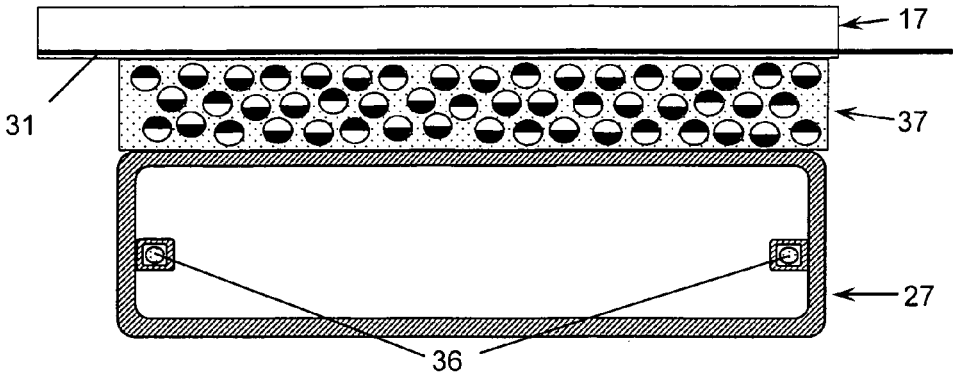
FIG. 6*a* schematically shows a cross-section of a single pixel in a plasma-addressed fiber-based display.
Figure 6B:
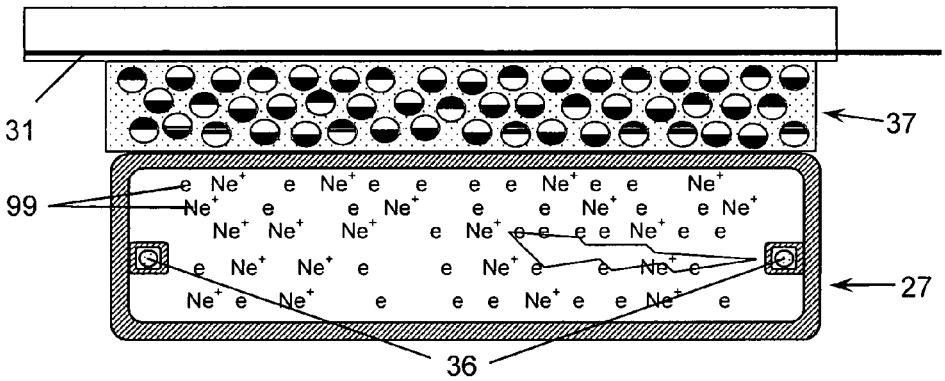
FIG. 6*b* schematically shows the charge generation in a plasma tube when a plasma is ignited.
Figure 6C:
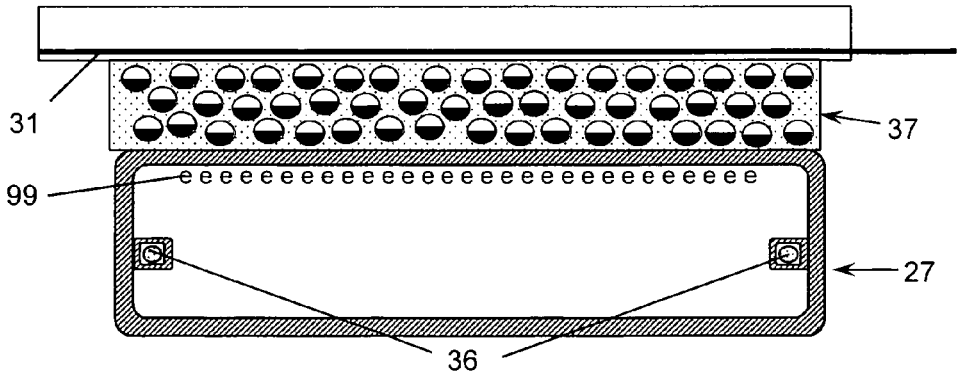
FIG. 6*c* schematically shows a layer of negative charge built-up on the inner surface of the plasma tube after being addressed.

FIG. 6 shows how the electro-optic material 37 (Gyricon paper) is addressed or an image is written on the display. FIG. 6*a* shows the cross-sectional structure of a single pixel of a plasma-addressed display with a random orientation of the bichromal spheres in the Gyricon paper 37. The display is addressed a row at a time by igniting a plasma in the first tube 27 of the panel generating a multitude of electrons (e) and positive ions ($Ne^+$) 99, as shown in FIG. 6*b*. During the plasma firing, positive or negative voltages are placed on each of the top fiber 17 column electrodes 31. This voltage attracts electrons or positive ions 99 toward the electrodes 31. However, the electrons or positive ions 99 are stopped by the inner surface of the plasma tube 27 where they stay and build up charge 99, as shown in FIG. 6*c*. To plate out electrons 99, as shown in FIG. 6*c*, a positive voltage needs to be applied to the column electrodes 31 during the plasma firing step, shown in FIG. 6*b*. Once the charge 99 is set-up on the inner surface of the plasma tube 27 and the plasma is extinguished, the charge 99 remains there until it bleeds off (>10 sec). By repeating this addressing process for each of the remaining tubes 27, charge 99 can be deposited at each pixel in the panel. Then when the voltage on all the column electrodes 31 are grounded, an electric field is set up through the electro-optic material 37 (Gyricon paper) from the charge 99 plated out in the tubes 27 to the grounded electrodes 31. This electric field causes the electro-optic material 37 to be modulated and an image to be generated. Note in the above example the black side of the bichromal spheres in the Gyricon paper 37 is charged positive with respect to the white side of the bichromal spheres.

Figure 7:
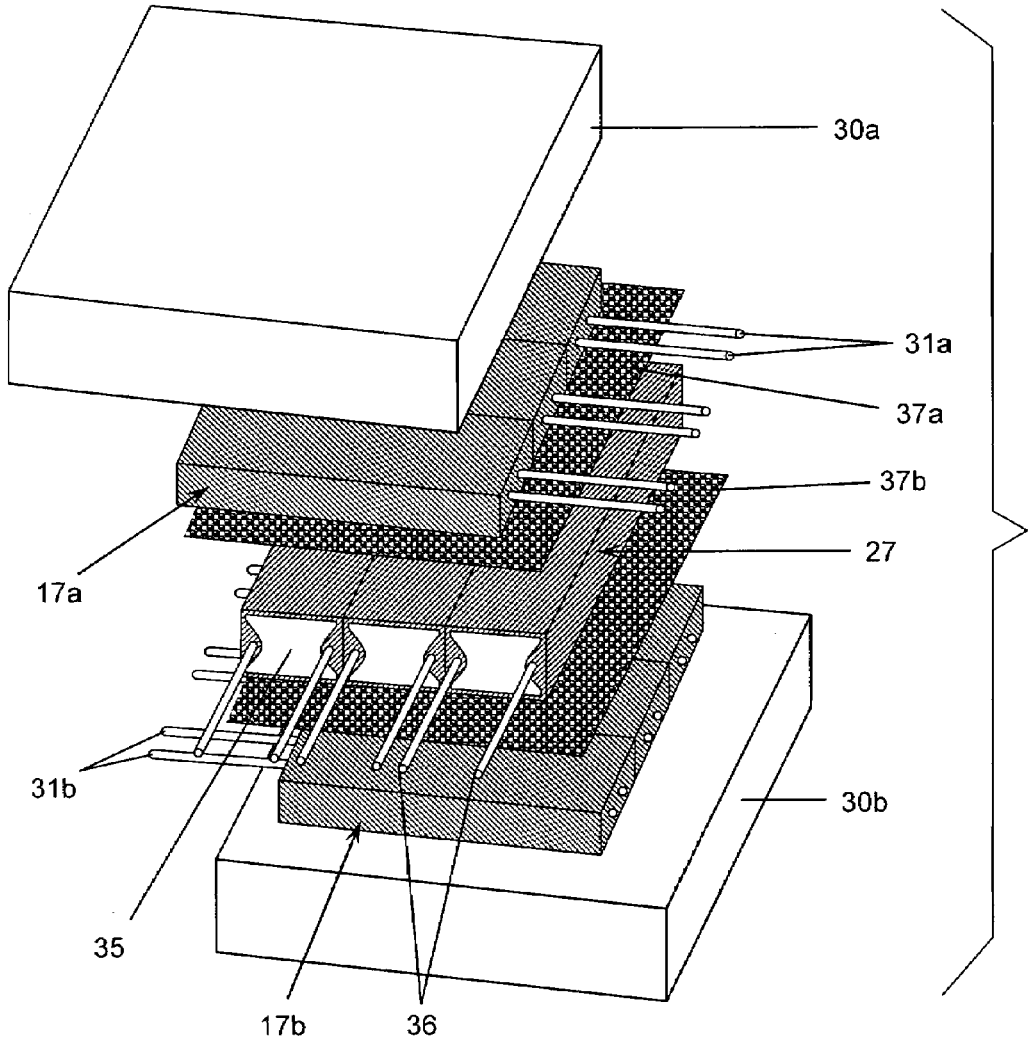
FIG. 7 illustrates a fiber-based plasma-addressed electro-optic display containing two electro-optic viewing surfaces and a single plasma tube array.

By modifying the structure of the plasma tubes 27 to have a first fiber array 17*a* and a second fiber array 17*b*, a tube with two thin walled sides for depositing charge 99 is fabricated. By placing an electro-optic material 37 and the second fiber array 17*b* against this second surface, a double-sided display is fabricated, as depicted in FIG. 7. Addressing both surfaces of this double-sided display is done similar to the single-sided display explained above, except, in addition to positive and negative voltage being applied to the first side electrodes 31*a* in the first fiber array 17*a* to plate-out charge 99*a*, positive and negative voltages are also applied to the second side electrodes 31*b* in the second fiber array 17*b* to plate-out charge 99*b* on the other side of the plasma tubes 27 during the plasma tube firing step.

Figure 8:
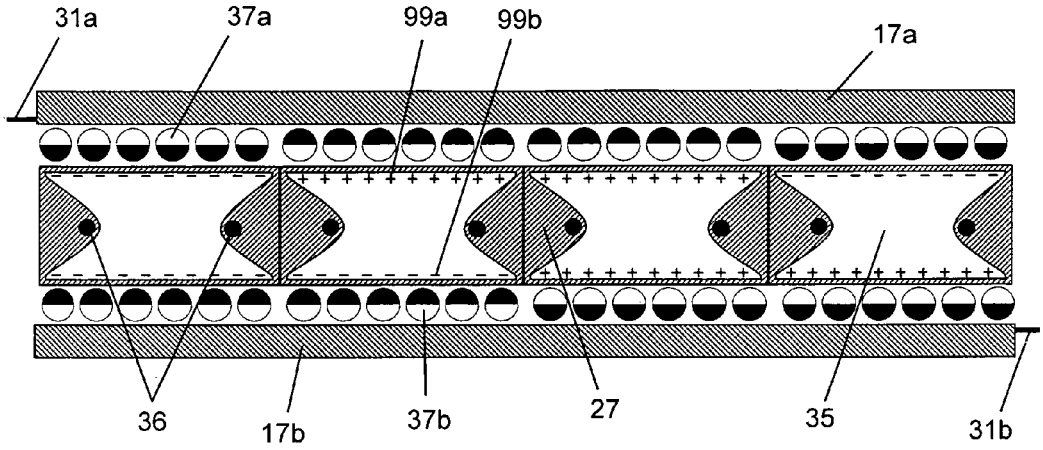
FIG. 8 schematically shows a cross-section of the active addressing region in the double-sided display in FIG. 5.

FIG. 8 schematically shows a cross-section of the active addressing area of four adjacent pixels with the four different combinations of plated out charges. The four different charge combinations creates black or white pixels on both sides of the panel assuming Gyricon papers 37*a* and 37*b* are used for the two electro-optic addressable materials. Creating two independently addressable surfaces using a single array of plasma tubes 27 and one set of drive electronics drastically reduces the overall cost of generating a display with two viewing surfaces as opposed to manufacturing two separate displays. In another embodiment, a double-sided display using two separate panels like the one shown in FIG. 5 preferably share the same high voltage drive electronics to reduce costs.

Figure 9:
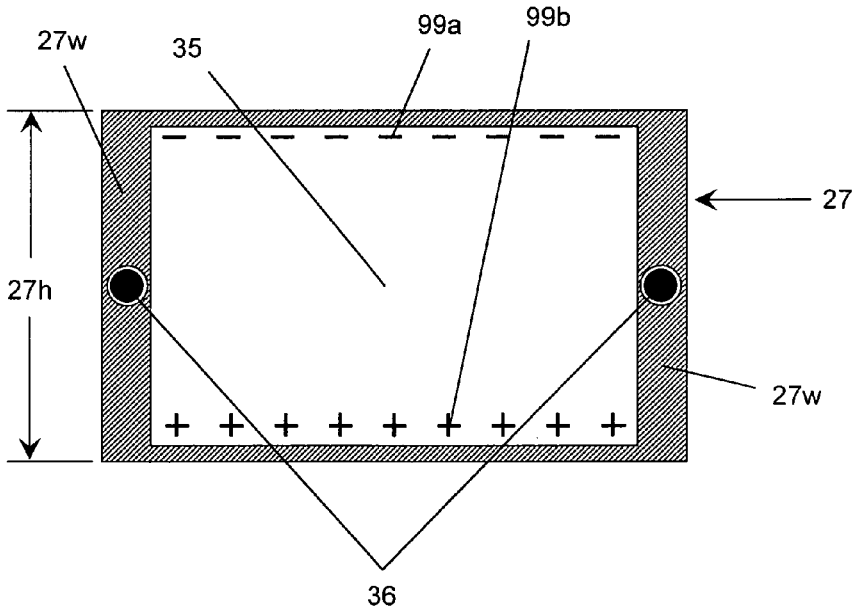
FIG. 9 schematically shows a cross-section of a plasma tube used in the double-sided display.

Many different electro-optic materials 37 can be used for the two light modulation regions. The use and operation of the display usually dictates which electro-optic materials 37*a* and 37*b* to use in both sides of the display. If a simple double-sided reflective display is desired, then there are many choices, such as, Gyricon paper, an electrophoretic material (for example the materials E-ink Corporation and SiPix Imaging, Inc. are developing), a suspended particle material (for example the materials Research Frontiers Incorporated are developing), or one of many different liquid crystal materials. However, if a transflective display or a display that operates in a transmissive and reflective mode is desired then the panel will have to have a reflective electro-optic material 37*a* on one side and a transmissive electro-optic material 37*b* on the other side. This transflective display would be viewed from one side but have two different addressable electro-optic materials 37*a* and 37*b*. If at least one of the two electro-optic materials 37 are used in a transmissive mode then the tube walls 27*w* have to be thinner, similar to that shown in FIG. 9, so the tube walls 27*w* do not protrude into the center of the tube where the wall 27*w* or plasma electrodes 36 would scatter or absorb light transmitting through the tube 27. Color could also be added to the display by coloring the fibers or tube similar to that disclosed in U.S. Pat. No. 6,459,200 entitled REFLECTIVE ELECTRO-OPTIC FIBER-BASED DISPLAYS, and U.S. Pat. No. 6,452,332 entitled FIBER-BASED PLASMA ADDRESSED LIQUID CRYSTAL DISPLAY. These patents are incorporated herein by reference. The sides 27*w* of the plasma tubes 27 could also be reflective to help guide the light traveling through the display.

In order to address thin electro-optic materials like liquid crystal or electrophoretic materials, the voltage on the column electrodes 31 has to be spread across the entire pixel width. In order to spread the charge across the pixel width or across the fiber 17, a transparent conductive coating has to be added to the fiber 17 and connected to the wire address electrode 31 as discussed in U.S. patent application Ser. No. 11/236,904, filed Sep. 28, 2005, entitled "ELECTRODE ENHANCEMENT FOR FIBER-BASED DISPLAYS", incorporated herein by reference. The fiber arrays 17 used to address the plasma (set the charge) and act as a ground plane may also be replaced with an electroded sheet, as discussed in U.S. Provisional Patent Application Ser. No. 60/749,446, filed Dec. 12, 2005, entitled "ELECTRODE ADDRESSING PLANE IN AN ELECTRONIC DISPLAY", and U.S. Provisional Patent Application Ser. No. 60/759,704, filed Jan. 18, 2006, entitled "ELECTRODE ADDRESSING PLANE IN AN ELECTRONIC DISPLAY AND PROCESS". These applications are incorporated herein by reference.

Figure 10A:
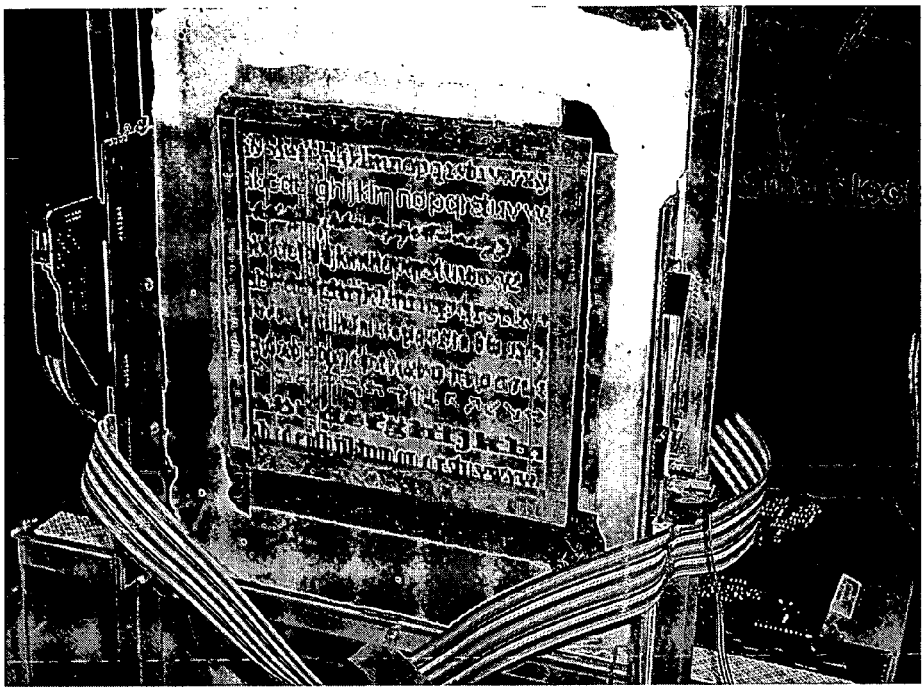
FIG. 10*a* is a photograph of side A of an operating 6.4"×6.4", 20 dpi, double-sided fiber-based plasma-addressed display using Gyricon paper as an electro-optic material.
Figure 10B:
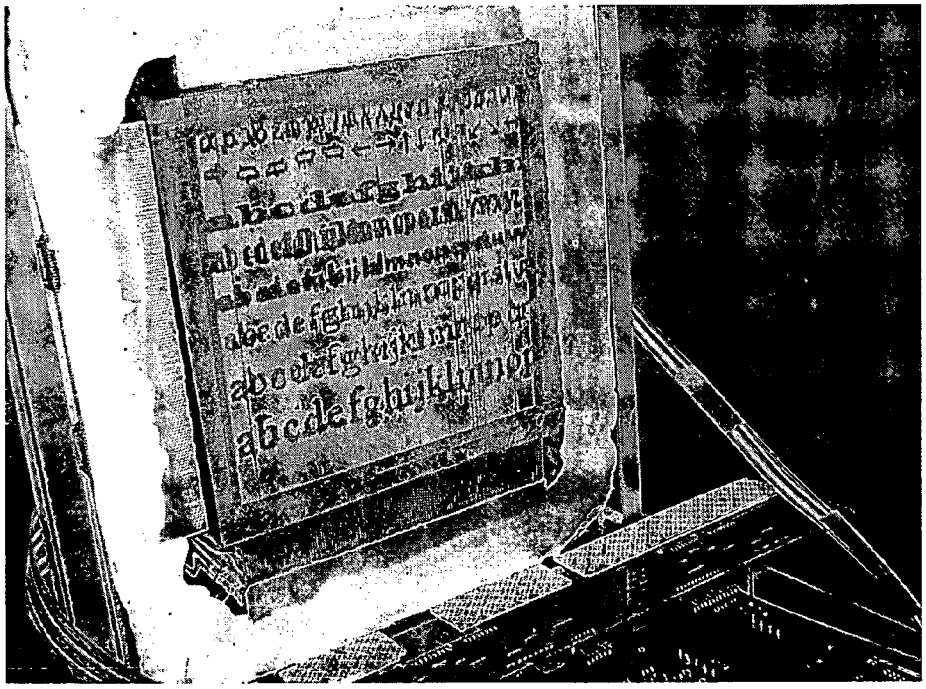
FIG. 10*b* is a photograph of side B of an operating 6.4"×6.4", 20 dpi, double-sided fiber-based plasma-addressed display using Gyricon paper as an electro-optic material.
Figure 11:
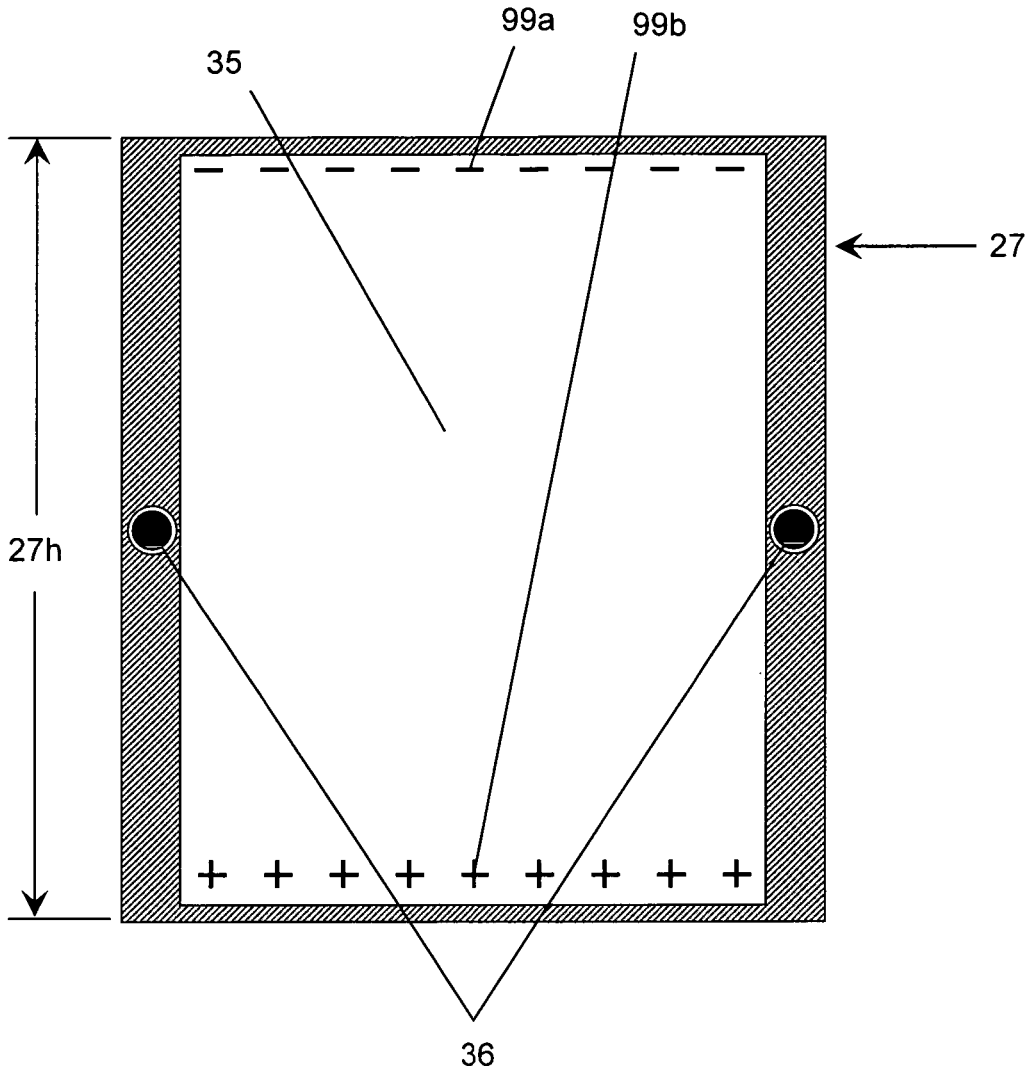
FIG. 11 schematically shows a cross-section of a plasma tube similar to that shown in FIG. 9 with a larger separation between charge depositing surfaces.
Figure 12:
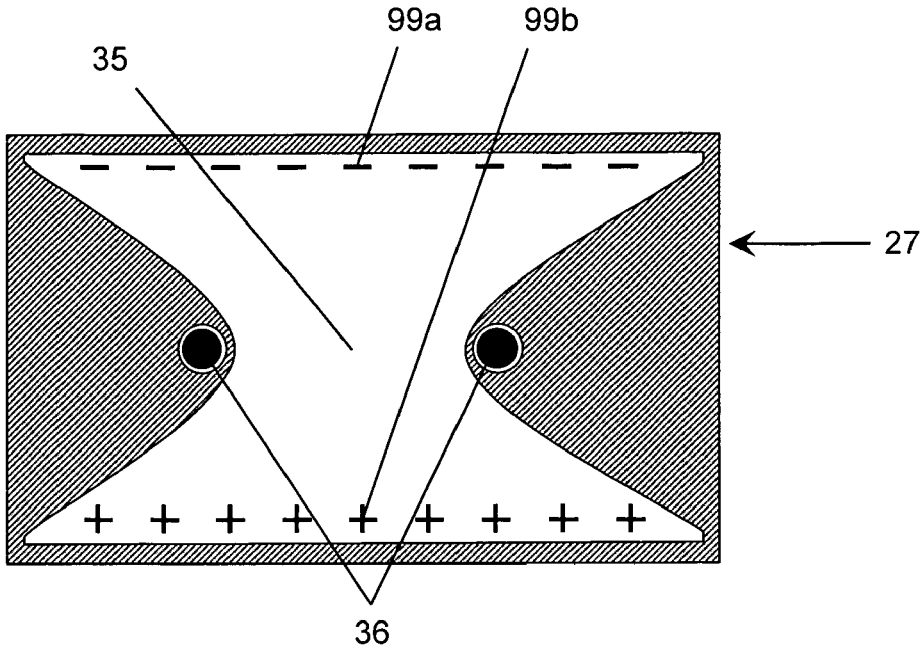
FIG. 12 schematically shows a cross-section of a plasma tube used in a double-sided display with the plasma electrodes located closer to the center of the tube to create an electrode plane to block the electrostatic field from a plated out charge on one side from affecting the plated out charge on the other side.
Figure 13:
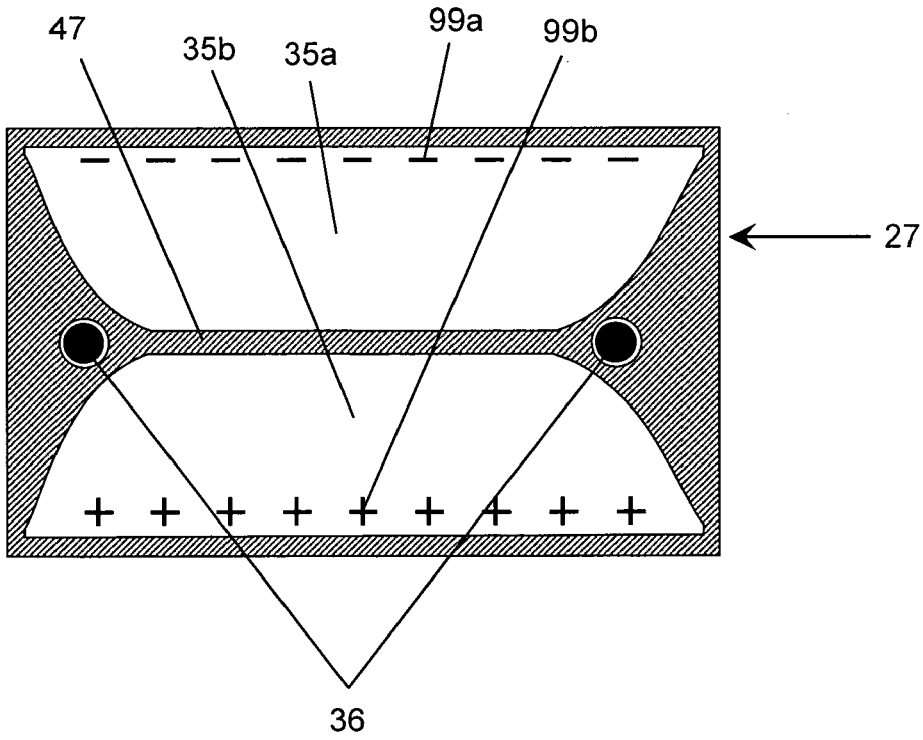
FIG. 13 schematically shows a cross-section of a tube used in a double-sided display with a center glass barrier to act as a charge neutral region in the tube.

FIG. 10 shows photographs of a double-sided display using a structure similar to that shown in FIG. 7. The electro-optic material 37 is Gyricon paper and the substrates 30 are 0.002" Mylar, which form a display that is only 2.3 mm thick and is flexible. The two images, FIG. 10*a* and 10*b*, were written one tube at a time, similar to that discussed above. A small amount of cross-talk can be observed in the two images. This small "ghost" image from the one side showing up in the other side is a result of the charge 99*a* plated out on one side causing some spheres to rotate in the Gyricon paper 37*b* on the other side. The plasma electrodes 36 are supposed to shield the electric field from this charge 99, however the tube height 27*h* (FIG. 9) is not large enough to allow the plasma electrodes 36 to completely block the electric field from the charge 99. Charge deposited on the tube surface creates field lines which decrease in magnitude as you radially move away from the charge. These field lines have to impinge on the plasma electrodes 36 before they come close to reaching the other surface or they will affect the charge (electric field) on that surface in turn effecting the modulation of electro-optic material 37 on that surface. One method that solves this cross-talk issue increases the height 27*h* of the plasma tubes with respect to the width or pixel pitch, as shown in FIG. 11. Another method moves the plasma electrodes 36 in toward the center of the plasma tubes 27, as shown in FIG. 12. Moving the plasma electrodes 36 away from the edge of the tubes 27 allows for a lower profile tube to be fabricated. FIG. 13 shows another method of creating an inner web that acts as a charge neutralization barrier in the center of the tube 27. A glass barrier 47 collects neutralization charge to cancel the electric field from the electro-optic modulation charge 99.

The above examples show that there are several different methods and structures for creating an actively addressed electro-optic region on both sides of a single plasma tube array. The above figures are only used as an example and are not intended to limit the scope of creating a double-sided display using a single plasma tube array.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An electronic display comprising:

a) at least one plasma tube array comprising a plurality of plasma tubes to form structure within the display, wherein each of the plasma tubes includes at least one wire electrode located greater than 1/10 of a distance from a side of the plasma tube to block an electric field from a first plated charge on a first surface of the plasma tube from interacting with a second plated charge on a second surface of the plasma tube; and b) at least two addressable electro-optic layers;

wherein the electronic display is double-sided.

2. The electronic display of claim 1, wherein the plasma tube array is sandwiched between the electro-optic layers.

3. The electronic display of claim 2, further comprising two fiber arrays comprising a plurality of fibers, wherein the fibers include wire electrodes, wherein the electro-optic layers are sandwiched between the fiber arrays.

4. The electronic display of claim 3, wherein the fibers are coated with a transparent conductive coating.

5. The electronic display of claim 4, wherein the conductive coating comprises a plurality of carbon nanotubes.

6. The electronic display of claim 4, wherein the conductive coating comprises a transparent conductive polymer.

7. The electronic display of claim 1, further comprising two electroded sheets including wire electrode, wherein the electro-optic layers are sandwiched between the two electroded sheets.

8. The electronic display of claim 1, wherein the plasma tubes include a charge neutralization layer to block an electric field from a first plated charge on a first surface of the plasma tube from interacting with a second plated charge on a second surface of the plasma tube.

9. The electronic display of claim 1, wherein the wire electrode is connected directly to a printed circuit board containing drive electronics.

10. An electronic display comprising a plasma tube array connected to drive electronics to address two separate electro-optic materials, wherein the display comprises:

a) two electro-optic materials:

b) two fiber arrays;

c) the plasma tube array, wherein the two fiber arrays sandwich the two electro-optic materials around the plasma tube array and wherein the two fiber arrays and the plasma tube array are substantially orthogonal and defining a structure of the display;

d) a top and bottom substrate that sandwich around the two fiber arrays;

e) wire electrodes within the two fiber arrays located near a surface of the fiber arrays on a side facing the electro-optic layer such that the wire electrodes can be used to set the charge in the plasma tubes in the plasma tube array to modulate the electro-optic materials; and f) wire electrodes within the plasma tube array such that the wire electrodes within the plasma tube array can be used to address a plasma in the plasma channels such that the plasma in the plasma channels is used to address the electro-optic materials;

wherein the drive electronics are connected to the wire electrodes within the two fiber arrays and the wire electrodes in the plasma tube array of the display.

11. An electronic display comprising a plasma tube array connected to drive electronics to address two separate electro-optic materials, wherein the display comprises:

a) two electro-optic materials;

b) two electroded sheets containing wire electrodes connected to transparent conductive strips which spread a voltage placed on the wire electrodes across a line of pixels;

c) the plasma tube array, wherein the two electroded sheets sandwich the two electro-optic arrays around the plasma tube array where the wires in the electroded sheets and the plasma tube array are substantially orthogonal and define a structure of the display;

d) wire electrodes within the two electroded sheets located near a surface of the electroded sheets on a side facing the electro-optic layer such that the wire electrodes within the two electroded sheets can be used to set the charge in the plasma tubes in the plasma tube array to modulate the electro-optic material; and e) wire electrodes within the plasma tube array such that the wire electrodes within the plasma tube array can be used to address a plasma in the plasma channels such that the plasma in the plasma channels is used to address the electro-optic materials;

wherein the drive electronics are connected to the wire electrodes in the electroded sheets and the wire electrodes in the plasma tube array of the display.

12. An electronic display comprising:

a) at least one plasma tube array comprising a plurality of plasma tubes to form structure within the display, wherein each of the plasma tubes includes at least one wire electrode that extends over 50 percent of the length of the plasma tube and shields a first charge from a first side of the plasma tube from a second charge on a second side of the plasma tube during addressing of the electro-optic materials; and b) at least two addressable electro-optic layers; wherein the electronic display is double-sided.

13. The electronic display of claim 12, wherein the plasma tube array is sandwiched between the electro-optic layers.

14. The electronic display of claim 13, further comprising two fiber arrays comprising a plurality of fibers, wherein the fibers include wire electrode, wherein the electro-optic layers are sandwiched between the fiber arrays.

15. The electronic display of claim 14, wherein the fibers are coated with a transparent conductive coating.

16. The electronic display of claim 15, wherein the conductive coating comprises a plurality of carbon nanotubes.

17. The electronic display of claim 15, wherein the conductive coating comprises a transparent conductive polymer.

18. The electronic display of claim 12, further comprising two electroded sheets including wire electrodes, wherein the electro-optic layers are sandwiched between the two electroded sheets.

19. The electronic display of claim 12, wherein the plasma tubes include a charge neutralization layer to block an electric field from a first plated charge on a first surface of the plasma tube from interacting with a second plated charge on a second surface of the plasma tube.

20. The electronic display of claim 12, wherein the wire electrode is connected directly to a printed circuit board containing drive electronics.

* * * * *

UNITED STATES PATENT AND TRADEMARK OFFICE

CERTIFICATE OF CORRECTION

PATENT NO. : 7,656,365 B2
APPLICATION NO. : 11/365157
DATED : February 2, 2010
INVENTOR(S) : Chad Byron Moore It is certified that error appears in the above-identified patent and that said Letters Patent is hereby corrected as shown below:

Column 6, line 65: replace "electrode" with "electrodes"

Column 8, line 28: replace "electrode" with "electrodes"

Signed and Sealed this

Eleventh Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,656,365 B2
APPLICATION NO. : 11/365157
DATED : February 2, 2010
INVENTOR(S) : Chad B. Moore It is certified that error appears in the above-identified patent and that said Letters Patent is hereby corrected as shown below:

Title page, item (*) Notice: Subject to any disclaimer, the term of this patent is extended or adjusted under 35 U.S.C. 154(b) by 626 days.

Delete "626 days" and insert --964 days--.

Signed and Sealed this

Twentieth Day of July, 2010

David J. Kappos

David J. Kappos
*Director of the United States Patent and Trademark Office*